US005417583A

United States Patent [19]

Ishizaki et al.

[11] Patent Number: 5,417,583

[45] Date of Patent: May 23, 1995

[54] INSULATION-PIERCING CONNECTOR

[75] Inventors: Sadao Ishizaki; Yoshiaki Igarashi, both of Tokyo, Japan

[73] Assignee: Daiichi Denshi Kogyo Kabushiki Kaisha, Tokyo, Japan

[21] Appl. No.: 250,376

[22] Filed: May 27, 1994

[30] Foreign Application Priority Data

May 31, 1993 [JP] Japan ..... 5-033450 U

[51] Int. Cl.[6] ..... H01R 13/58

[52] U.S. Cl. ..... 439/409; 439/459

[58] Field of Search ..... 439/417, 457, 459, 409, 439/456

[56] References Cited

U.S. PATENT DOCUMENTS 4,224,465 9/1980 Ruzic ..... 439/459
4,830,625 5/1989 Vignoli ..... 439/417
5,041,009 8/1991 McCleerey ..... 439/417

FOREIGN PATENT DOCUMENTS 427132 5/1991 European Pat. Off. ..... 439/409
3-68362 4/1991 Japan .
1479987 5/1989 U.S.S.R. ..... 439/457

*Primary Examiner*—Gary F. Paumen
*Attorney, Agent, or Firm*—Silverman, Cass & Singer, Ltd.

[57] ABSTRACT

An insulation-piercing connector includes a terminal block having therein a plurality of piercing terminals, and a piercing block having wire receiving apertures. When the terminal and piercing blocks are forced closer together, insulated wires of a cable received in the wire receiving apertures of the piercing block are forced into U-shaped grooves of the piercing terminals so that inner edges of the U-shaped grooves pierce into conductors of the insulated wires to electrically connect between the conductors and the piercing terminals, respectively. The piercing block is further formed at the forward ends of the wire receiving apertures with U-shaped grooves whose opposed walls form flanges which may be tapered toward each other. A distance between the opposed walls of the U-shaped grooves is less than the outer diameter of the insulated wires but more than the outer diameter of the conductors of the wires.

10 Claims, 8 Drawing Sheets

INSULATION-PIERCING CONNECTOR

BACKGROUND OF THE INVENTION

The present invention relates to an insulation-piercing connector including a piercing block for receiving a cable inserted therein and a terminal block having therein piercing terminals adapted to pierce the cable so as to accomplish electrical connection therebetween when the piercing and terminal blocks are forced closer together.

One example of conventional insulation-piercing connectors is shown in a perspective view of FIG. 6 and sectional views of FIGS. *7a* and *7b* for explanatorily illustrating the construction of the connector and its insulation-piercing connection. The insulation-piercing connector 1 is composed of a terminal block 2 and a piercing block 3. The terminal block 2 is formed with a plurality of connection apertures 4 for receiving contacts of a male connector (not shown) to be connected to the connector 1 and is provided with L-shaped piercing terminals 6 fitted in terminal grooves 5 communicating with the connection apertures 4. Each of the L-shaped piercing terminals 6 has a U-shaped grooved portion *6a* to be fitted in the terminal grooves 5 to form a contact portion to be connected with one of contacts of the male connector (not shown). Each of the piercing terminals 6 has also a vertical portion *6b* which is formed with a V-shaped piercing groove *6c* into which an insulated wire 7 of a cable is press-fitted.

The piercing block 3 is pivotally connected to the terminal block 2 by means of a hinge 8 generally integrally formed with both the blocks 2 and 3. The piercing block 3 is formed with wire receiving apertures 9 passing therethrough in the connecting direction of the connector 1. The insulated wires 7 of the cable received in the apertures 9 are pierced with inner edges of the piercing grooves *6c* to electrically connect the wires 7 to the piercing terminals 6 when the terminal block 2 and the piercing block 3 are forced closer together.

"To force blocks closer together" used herein means that the blocks are forced toward each other to form a united body.

The piercing block 3 is formed with V-shaped grooves 10 at the respective ends of the wire receiving apertures 9 on the side where the forward ends of the insulated wires 7 project from the piercing block 3 after inserted through the apertures 9. The V-shaped grooves 10 embrace or hold at their bottoms the ends of the insulated wires 7 in curved state after the forward ends of the insulated wires 7 projecting from the apertures 9 have been bent upwards. The piercing block 3 is further formed with receiving openings 11 substantially perpendicular to the wire receiving apertures 9 for receiving the distal ends of the vertical portions *6b* of the piercing terminals 6, respectively.

In piercing the cable in the connector 1, the insulated wires 7 of the cable are inserted in the direction shown by an arrow E in FIG. *7a* into the wire receiving apertures 9 of the piercing block 3 in an open condition where the piercing block 3 has been pivoted about the hinge 8 relative to the terminal block 2 from the closed condition shown in FIG. 6. The forward ends of the insulated wires 7 projecting from the apertures 9 are then bent upwards so as to hold the bent portions of the wires 7 by means of the bottoms of the V-shaped grooves 10. In this state, extra portions of the insulated wires 7 projecting from the grooves 10 are cut off along a dot-and-dash line 12 in FIG. *7a* by means of cutting means such as pliers (not shown). Therefore, conductors of the insulated wires of the cable appear at their cut ends, which make it possible to ascertain in continuity test whether the plurality of conductors have been connected in position to the piercing terminals 6 in an intended fashion without any wrong connection therebetween.

After completion of the continuity test, the terminal and piercing blocks 2 and 3 are forced closer together to join them as shown in FIG. *7b*. In the joining operation, the respective insulated wires 7 of the cable received in the wire receiving grooves 9 are pierced with the inner edges of the V-shaped piercing grooves *6c* so that the inner edges of the grooves *6c* pass through insulators of the wires 7 and penetrate into the conductors, thereby electrically connecting the conductors of the insulated wires 7 to the piercing terminals 6, respectively. FIG. 6 illustrates in a perspective view the insulation-piercing connector 1 whose piercing terminals 6 have been connected to the conductors of the cable.

In such a connector of the prior art described above, insulated wires 7 of a cable are inserted and supported in the wire receiving apertures 9 and the forward ends of the wires 7 are then bent upwards so as to be held by the inner walls of the V-shaped grooves 10 at the ends of the apertures 9, thereby enabling the extra portions projecting from the grooves 10 to be cut off by means of cutting means such as pliers. However, since the inner walls of the V-shaped grooves 10 open progressively widely or away from each other towards the outside of the grooves 10, the wires cannot be sufficiently securely held by the grooves 10. Particularly, with a cable having twisted wires, there is a tendency of the wires to come out of the V-shaped grooves 10 owing to the restoring force of the wires returning to their original straight positions. As a result, cut ends of the wires direct in lateral directions at random.

In continuity test, therefore, it may be difficult, if not impossible, to bring one end of a probe for the continuity test into contact with wires of the cable due to the laterally directing cut ends of the wires, which also make it difficult to perform the continuity test itself.

In case of a continuity test of circuits for an appliance such as a switchboard whose male connector has been connected to the insulation-piercing connector 1, an operator cannot clearly see from above the cut ends of insulated wires 7 of the cable of the connector because of the cut ends directing laterally at random. Accordingly, the continuity test must be carried out in an undesirable condition and become more difficult for the operator depending upon the connected state of the insulation-piercing connector 1.

SUMMARY OF THE INVENTION

It is an object of the invention to provide an improved insulation-piercing connector which is able to grip wires of a cable more firmly at forward ends of the wire receiving apertures of the piercing block of the connector so that cut ends of the wires can be clearly seen from above the piercing block so as to make it easy to carry out a continuity test at the cable connected to the connector even if the wires are twisted, to say nothing of solid wires.

It is another object of the invention to provide an insulation-piercing connector which is easy to perform a continuity test before forcing the piercing and terminal blocks of the connector closer together or connecting conductors of a cable to piercing terminals, thereby preventing any wrong connection therebetween.

In order to accomplish the object of the invention, in an insulation-piercing connector including a terminal block having therein a plurality of piercing terminals each formed with a piercing groove whose inner edges pierce into the conductor of an insulated wire of a cable to electrically connect between the conductor and a piercing terminal, and a piercing block having wire receiving apertures for receiving and holding therein insulated wires of the cable in opposition to the piercing terminals and forcing the insulated wires into piercing grooves of the piercing terminals when the terminal and piercing blocks are forced closer together, according to the invention the piercing block is formed at the forward end of each of the wire receiving apertures with a U-shaped groove whose opposed walls form flanges tapered toward each other, and a distance between the opposed walls is less than the outer diameter of one insulated wire but more than the outer diameter of the conductor of the wire for holding the insulated wire at the side opposite to the side where the insulated wire is inserted into the wire receiving aperture.

The tapered flanges have a dimension and a shape which are able to bite somewhat into insulators of the insulated wires of a cable. Moreover, the piercing block may be further formed with a partial opening at the forward end of each of the wire receiving apertures. Accordingly, even after the extra portions of insulated wires have been cut by means of cutting means, the cut end faces of the wires are held so as to be seen from above the piercing block.

With the arrangement described above, the insulation-piercing connector according to the invention is able to firmly grip insulated wires of a cable projecting from the wire receiving grooves of the connector so as to hold cut ends of the insulated wires, thereby enabling an operator to see the cut ends from above the piercing block without any difficulty. Therefore, continuity test can easily be performed with the cable connected to the connector with considerably improved efficiency.

Moreover, before forcing the piercing and terminal blocks closer together, it is possible to perform a continuity test readily to eliminate errors in connection between piercing terminals and conductors of a cable.

The invention will be more fully understood by referring to the following detailed specification and claims taken in connection with the appended drawings.

DESCRIPTION OF THE PREFERRED EMBODIMENTS

Figure 5A:
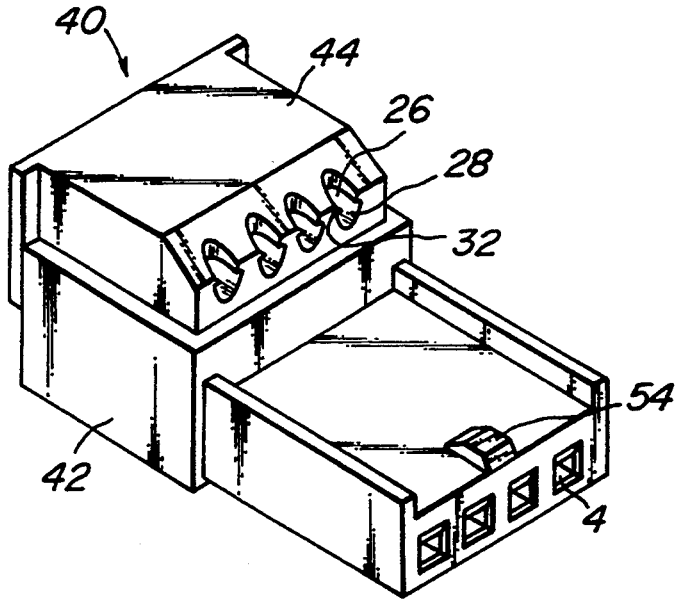
FIG. 5*a* is a perspective view of an insulation-piercing connector of another embodiment according to the invention after removal of a cable connected to its piercing block.
Figure 5B:
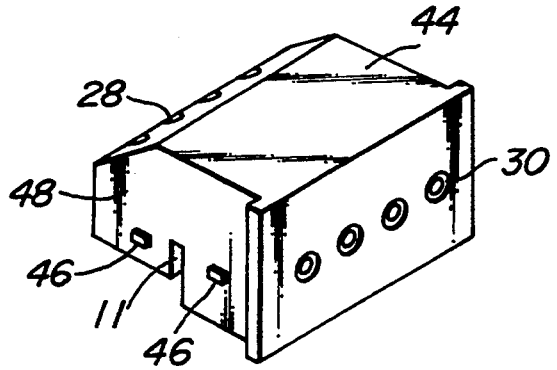
FIG. 5*b* is a perspective view illustrating the piercing block of the connector shown in FIG. 5*a;*
Figure 5C:
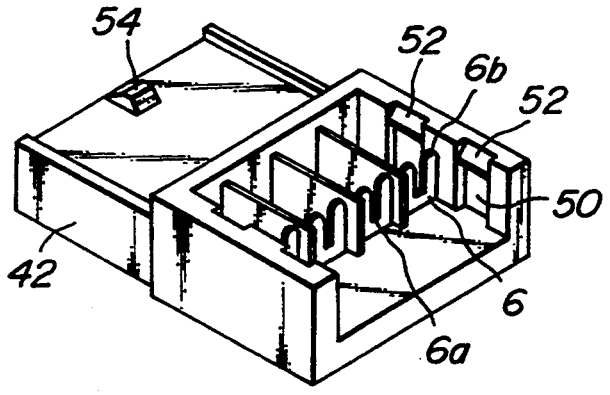
FIG. 5*c* is a perspective view illustrating the terminal block of the connector shown in FIG. 5*a;*
Figure 6:
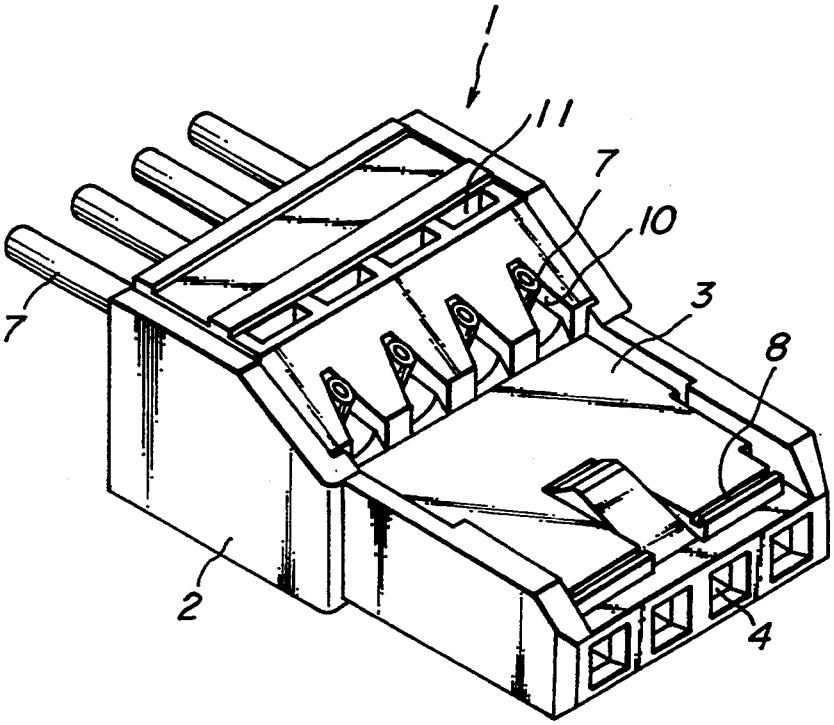
FIG 6 PRIOR ART
FIG. 6 is a perspective view illustrating an insulation-piercing connector of the prior art.
Figure 7A:
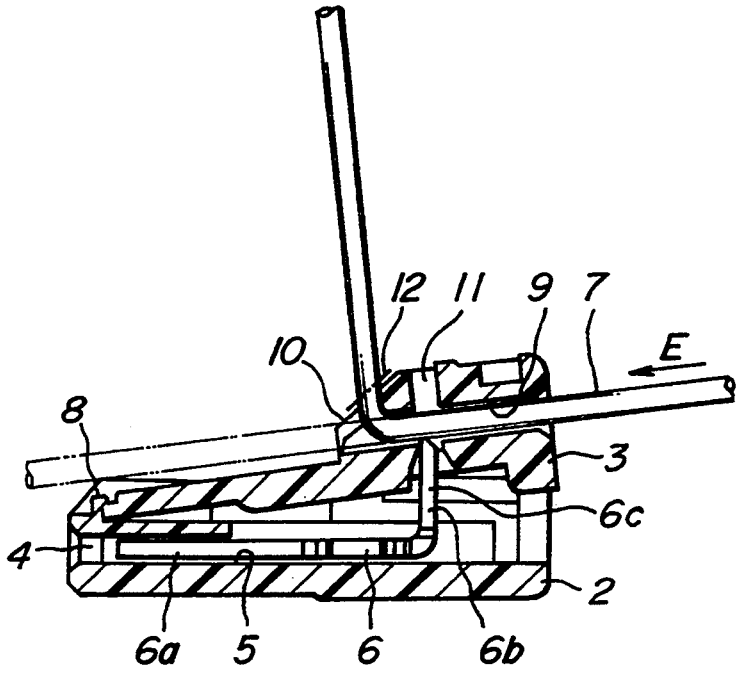
FIG. 7a PRIOR ART
FIG. 7*a* is a sectional view of the connector immediately before insulated wires of a cable are pierced with piercing terminals of the connector shown in FIG. 6.
Figure 7B:
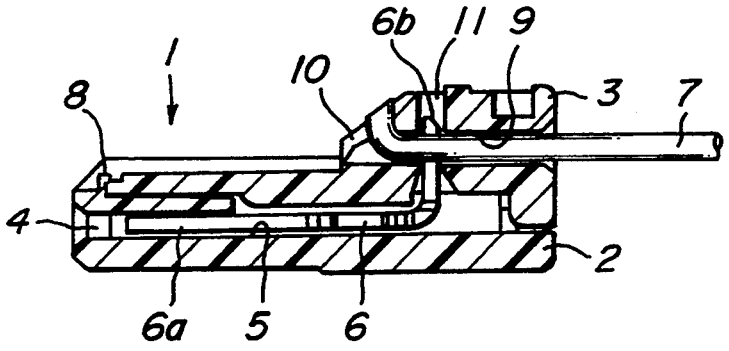
FIG. 7b PRIOR ART
FIG. 7*b* is a sectional view of the connector immediately after the insulated wires of a cable have been pierced with piercing terminals of the connector shown in FIG. 6.

In FIGS. 1 to 5 illustrating the embodiments according to the invention, like components have been designated by the same reference numerals used in FIGS. 6 and 7 and will not be described in further detail. The insulation-piercing connector according to the invention explained herein is of the order of 18 mm length, 12.5 mm width and 7.4 mm height in size in the case of 2.5 mm pitch of piercing terminals for four wires of a cable. The width of such a connector depends upon the pitch of piercing terminals and the number of wires of a cable.

The connector according to the invention is composed of insulating bodies such as terminal and piercing blocks and piercing terminals having contact portions to be contacted with a mating or male connector and piercing grooves piercing into insulated wires of a cable. Therefore, piercing terminals are required to have a springiness because they are fitted with a male connector and pierced into insulated wires. In the present invention, copper alloys are used for the piercing terminals such as phosphor bronze, beryllium-copper or the like. In consideration of the forced fitting of the terminal and piercing blocks, they are required to have a high toughness. A glass-fiber-reinforced polyamide plastic is used for the blocks in the present invention. However, any other resins may be used for this purpose so long as they have strengths sufficient to resist the force caused when the terminal and piercing blocks are forced closer together. Glass-fiber-reinforced polybutylene terephthalate or polycarbonate is preferable.

Figure 1:
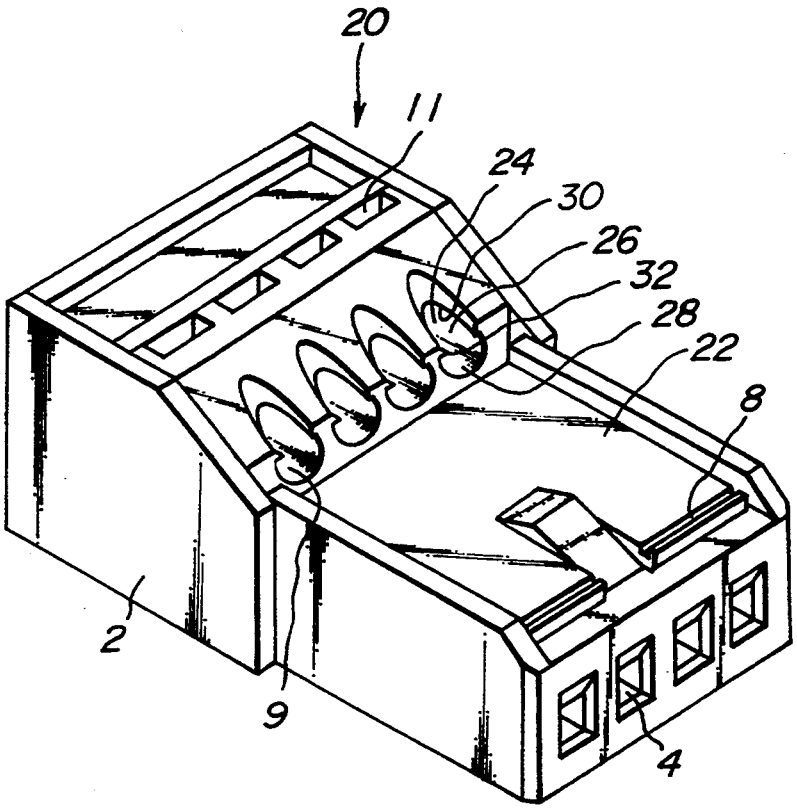
FIG. 1 is a perspective view of an insulation-piercing connector of the first embodiment according to the invention.
Figure 2A:
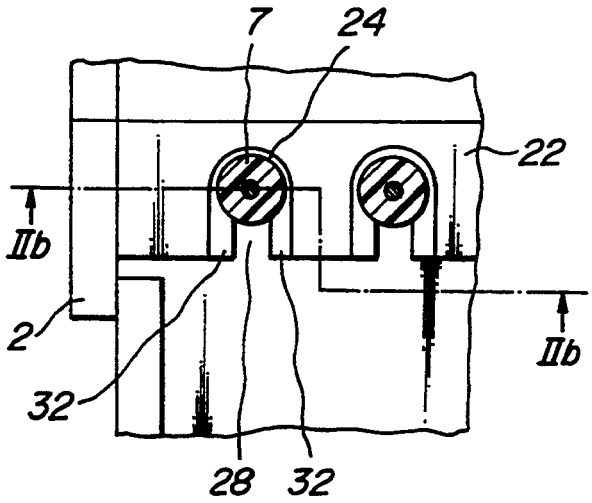
FIG. 2*a* is a partial plan view of a principal part of the connector shown in FIG. 1.
Figure 2B:
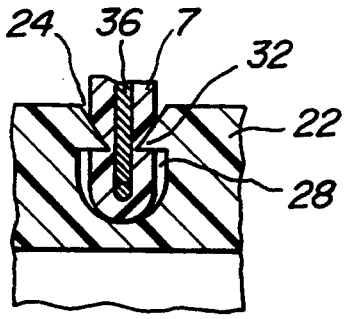
FIG. 2*b* is a partial sectional view of a principal part of the connector shown in FIG. 1.

FIGS. 1 and FIGS. 2*a* and 2*b* illustrate the insulation-piercing connector 20 of the first preferred embodiment of the invention before connecting a cable thereto. The connector 20 includes a terminal block 2 having therein piercing terminals 6 and a piercing block 22 pivotally connected to the terminal block 2 by means of a hinge 8 as in the prior art insulation-piercing connector 1 shown in FIGS. 6 and 7. Different from the prior art connector 1, the insulation-piercing connector 20 according to the invention comprises features of providing partial openings 24 and U-shaped grooves 26 at forward ends 28 of wire receiving apertures 30 of the piercing block 22 as explained herein and shown in FIGS. 2*a* and 2*b*.

As is clear in these drawings, insulated wires 7 of a cable can be horizontally projected from the forward ends 28 of the wire receiving apertures 30. The piercing block 22 is formed with the partial openings 24 in the proximity of the upper portions of the forward ends 28 of the wire receiving apertures 30, respectively. The bottom of each of the partial openings 24 is formed with a U-shaped groove 26 whose opposed walls are narrowed downwardly toward the wire receiving aperture 30 to form tapered flanges 32 in this embodiment as shown in FIG. 2*b*. As described above, the forward ends 28 are on the side opposite to the side where the wires are inserted into the wire receiving apertures 30 and serve to hold the forward ends of the wires. Although the opposed walls of the U-shaped grooves 26 extend in parallel with the inserting direction of the insulated wires 7, they may be somewhat inclined relative to the inserting direction.

The minimum width of the U-shaped grooves 26 should be suitably selected within the range less than the outer diameter of the insulated wires 7, but more than the outer diameter of the conductors of the insulated wires. Therefore, when the forward ends of the insulated wires 7 projecting from the forward ends 28 of the wire receiving apertures 30 are bent upwards, parts of the insulated wires 7 are forced into the U-shaped grooves 26 and the tapered edges of the tapered flanges 32 bite into the insulated wires, whereby the insulated wires 7 are firmly held therebetween. Moreover, in addition, or alternatively, tapered surfaces of the flanges 32 may be provided on the inner side or on the side of the wire receiving apertures 30 to increase the gripping force of the U-shaped grooves for the insulated wires.

According to the invention, the U-shaped grooves 26 having the tapered portions are formed at the forward ends 28 of the wire receiving apertures 30 as explained above. Therefore, when the forward ends of insulated wires projecting from the forward ends 28 of the wire receiving apertures 30 are bent upward, the tapered flanges 32 of the U-shaped grooves 26 bite into the insulators of the wires to grip the forward ends of the insulated wires 7 firmly. Accordingly, even after cut the extra portions of the insulated wires by means of cutting means such as pliers, the cut end faces are held so as to be seen from above the piercing block so that it is possible to carry out continuity tests with ease for testing the electrical connection between the connector and wires of a cable or in associated circuits.

Figure 3A:
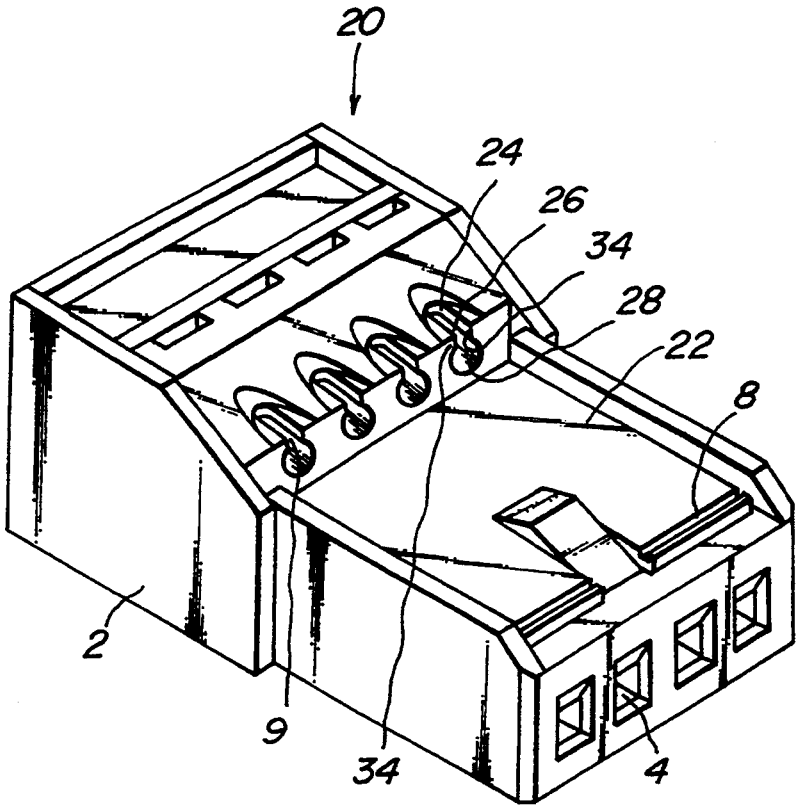
FIG. 3*a* is a perspective view of an insulation-piercing connector of the second embodiment according to the invention.
Figure 3B:
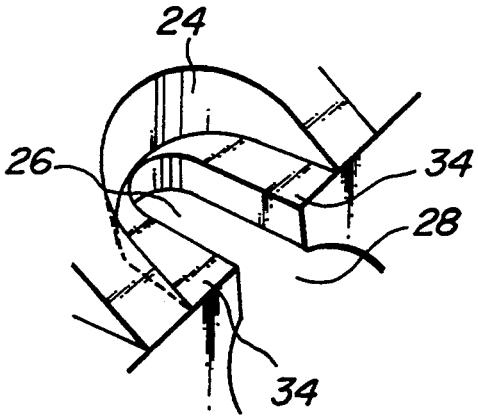
FIG. 3*b* is a partial perspective view illustrating the forward end of a wire receiving aperture of the connector shown in FIG. 3*a;*
Figure 4A:
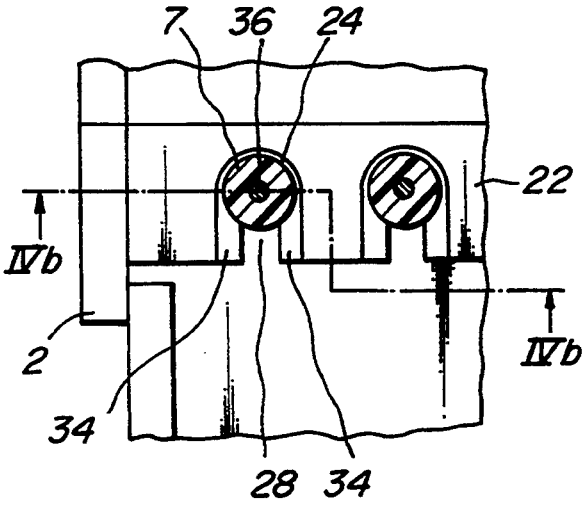
FIG. 4*a* is a partial plan view of a principal part of the connector shown in FIG. 3*a;*
Figure 4B:
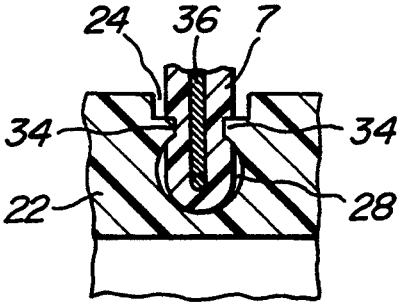
FIG. 4*b* is a partial sectional view of a principal part of the connector shown in FIG. 3*a;*

FIGS. 3*a* and 3*b* illustrate a second preferred embodiment of the invention, in which like components have been designated by the same reference numerals used in the first embodiment. In the second embodiment, flanges 34 are slightly modified to have flat surfaces on their upper sides. In this case, as shown in FIG. 4*b* flanges 34 form rigid wedges with their lower surfaces and hence the inner surfaces of the wire receiving apertures 30 which is substantially tapered in place of the upper tapered surfaces of the flanges 32 in the first embodiment. The flanges 34 in the form of wedges increase their rigidity and make easy to bite into the insulators of the wires to grip them firmly.

Various modifications of the flanges 34 are shown in FIGS. 4*c* to 4*g*. It should be understood that the flanges may be formed in any shape, so long as it fulfills the following requirements. The minimum width of the U-shaped grooves 26 forming the flanges is within the range less than the outer diameter of the insulated wires, but more than the outer diameter of the conductors 36 of the wire. The inner edges of the flanges or the inner walls of the U-shaped grooves have a shape capable of biting into the insulators of the wires when the projecting insulated wires are bent upwards. Moreover, the flanges have a strength sufficient to bite into the insulations and to grip them firmly without being damaged.

The flanges 34 may have any cross-section. The cross-sections of the flanges 34 are substantially triangular in FIGS. 4*c*, 4*f* and 4*g*, trapezoidal in FIG. 4*d* and rectangular in FIG. 4*e*. In the case shown in FIG. 4*b*, the flanges extend inwardly toward each other a distance of the order of 0.7 mm and have a thickness of the order of 0.5 mm.

Glass-fiber-reinforced polyamide plastic is ideal as the material for the terminal block 2 and the piercing block 22 in order to prevent the flanges 32 and 34 from being damaged.

In the illustrated embodiment, the U-shaped grooves 26 having the flanges 34 are formed at the forward ends 28 of the wire receiving apertures 30 in the similar manner to the previous embodiment. Therefore, when the forward ends of insulated wires projecting from the forward ends 28 of the wire receiving apertures 30 are bent upward, the flanges 34 bite into the insulators of the wires to grip the forward ends of the insulated wires 7 firmly. Accordingly, even after cut the extra portions of the insulated wires by means of cutting means such as pliers, the cut end faces are held so as to be seen from above the piercing block so that it is possible to carry out continuity tests with ease for testing the electrical connection between the connector and wires of a cable or in associated circuits.

Figure 4C:
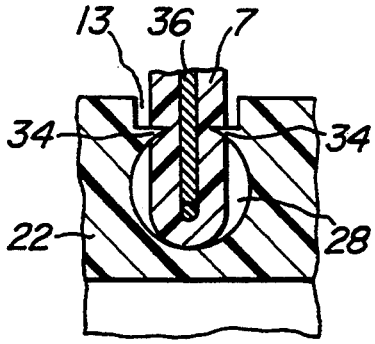
FIGS. 4*c* to 4*g* are partial sectional views of various modifications of the principal part of the connector shown in FIG. 3*a;*
Figure 4D:
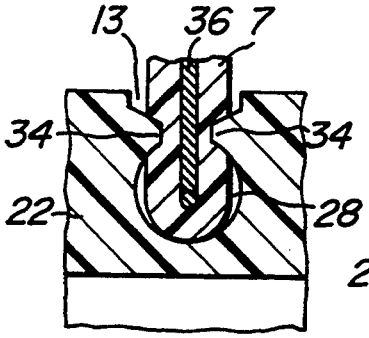
Figure 4E:
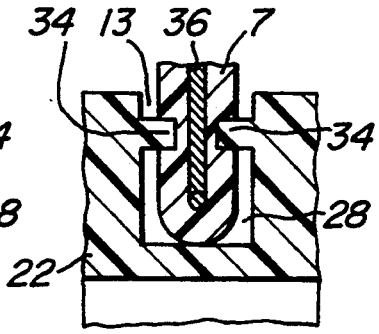
Figure 4F:
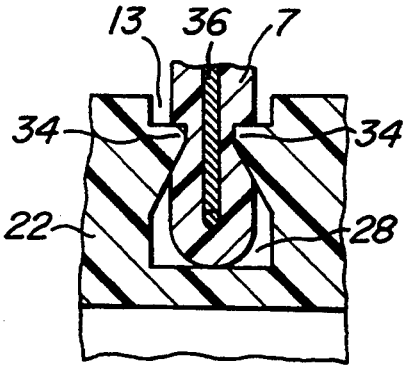
Figure 4G:
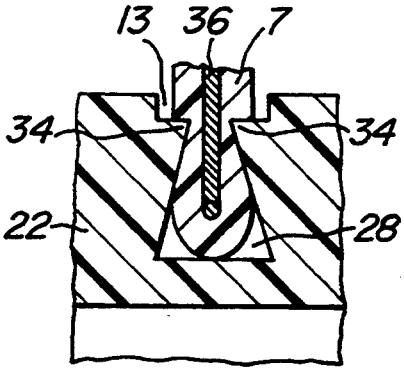

The wire receiving apertures 30 may have any cross-section so long as they permit required insulated wires 7 to pass therethrough. For example, the cross-section may be circular as shown in FIGS. 4*b* to 4*d*, rectangular in FIG. 4*e*, triangular in FIG. 4*g*, and pentagonal in FIG. 4*f*.

While the insulation-piercing connectors including the pivotally connected terminal and piercing blocks have been explained in the first and second embodiments, the invention may be applicable to an insulation-piercing connector 40 including a terminal block 42 and a piercing block 44 separately formed or not connected by pivotal means as shown in FIG. 5*a*. The construction of such a connector 40 will be explained hereinafter.

FIG. 5*a* illustrates in a perspective view the insulation-piercing connector 40 whose terminal and piercing blocks 42 and 44 are made in separate parts, but now joined together. FIGS. 5*b* and 5*c* show the piercing block 44 and terminal block 42, respectively, viewed in opposite direction to that of FIG. 5*a*. The connector 40 employs the U-shaped grooves 26 and the tapered flanges 32 at the forward ends 28 of the wire receiving apertures 30 shown in FIG. 1. The features of the U-shaped grooves 26 and the flanges 34 shown in FIGS. 3*a* and 3*b* may also be applicable to the connector 40.

The piercing block 44 is formed with protrusions 46 at both its outer side surfaces 48, while the terminal block 42 is formed with engaging grooves 50 in its inner surfaces mating with the outer side surfaces 48 of the piercing block 44. Each of the engaging grooves 50 is formed at its outer end with a projection 52 having a slightly oblique surface facing outwardly.

In piercing operation, after insulated wires 7 of a cable have been inserted in wire receiving apertures 30 of the piercing block 44 and forward ends of the insulated wires 7 have been cut, the piercing block 44 is positioned on the terminal block 42 so that the protrusions 46 are in contact with the oblique surfaces of the projections 52, respectively. The two blocks 42 and 43 are then forced closer together to cause the protrusions 46 on the piercing block 44 to ride over the projections 52 and become into engagement in the engaging grooves 50. In this manner, the two blocks are joined with each other and the piercing operation is completed.

Such a joining operation of the terminal and piercing blocks 42 and 44 can be readily performed by manufacturing the two blocks by a plastic material as an insulating material which allows its slight elastic deformation.

As shown in FIGS. 5*a* and 5*c*, the terminal block 42 is formed at its one end with a trapezoidal raised portion 54 which serves to prevent a male connector (not shown) connected to the connector 40 from disconnecting therefrom.

As can be seen from the above explanation, the insulation-piercing connector according to the invention can firmly grip insulated wires of a cable projecting from the wire receiving grooves of the connector so as to hold cut ends of the insulated wires in a manner enabling an operator to see the cut ends from above the piercing block. Therefore, continuity test can easily be performed with the cable connected to the connector with considerably improved efficiency.

While the invention has been particularly shown and described with reference to preferred embodiments thereof, it will be understood by those skilled in the art that the foregoing and other changes in form and details can be made therein without departing from the scope of the claims.

What is claimed is:

1. An insulation-piercing connector including a terminal block having therein a plurality of piercing terminals each formed with a piercing groove whose inner edges pierce into the conductor of an insulated wire of a cable to electrically connect between the conductor and a piercing terminal, and a piercing block having wire receiving apertures for receiving and holding therein insulated wires of the cable in opposition to said piercing terminals and forcing said insulated wires into piercing grooves of the piercing terminals when said terminal and piercing blocks are forced closer together, wherein said piercing block is formed at the forward end of each of said wire receiving apertures with a U-shaped groove whose opposed walls form flanges tapered toward each other, and a distance between said opposed walls is less than the outer diameter of one insulated wire but more than the outer diameter of the conductor of the wire for holding the insulated wire at the side of the piercing block opposite to the side where the insulated wire is inserted into the wire receiving aperture.

2. The insulation-piercing connector as set forth in claim 1, wherein the opposed walls of said U-shaped grooves have a shape and a dimension which are able to bite somewhat into insulators of the insulated wires of the cable.

3. The insulation-piercing connector as set forth in claim 1, wherein the sectional shape of said opposed walls is selected from shapes substantially in the form of a triangle, trapezoid and rectangle.

4. The insulation-piercing connector as set forth in claim 1, wherein said piercing block is formed with a partial opening at the forward end of each of said wire receiving apertures.

5. The insulation-piercing connector as set forth in claim 1, wherein when said insulated wires of the cable have been inserted into said wire receiving apertures of said piercing block and forward ends of the insulated wires projecting from the forward ends of the wire receiving apertures have been bent upwards, the opposed walls of the U-shaped grooves firmly grip the forward ends of the insulated wires, respectively, so that even after the projecting forward ends of the insulated wires have been cut, cut ends of the insulated wires are able to be seen from above the piercing block.

6. An insulation-piercing connector including a terminal block having therein a plurality of piercing terminals each formed with a piercing groove whose inner edges pierce into the conductor of an insulated wire of a cable to electrically connect between the conductor and a piercing terminal, and a piercing block having wire receiving apertures for receiving and holding therein insulated wires of the cable in opposition to said piercing terminals and forcing said insulated wires into piercing grooves of the piercing terminals when said terminal and piercing blocks are forced closer together, wherein said piercing block is formed at the forward end of each of said wire receiving apertures with a U-shaped groove whose opposed walls form flanges, and a distance between said opposed walls is less than the outer diameter of one insulated wire but more than the outer diameter of the conductor of the wire for holding the insulated wire at the side of the piercing block opposite to the side where the insulated wire is inserted into the wire receiving aperture.

7. The insulation-piercing connector as set forth in claim 6, wherein the opposed walls of said U-shaped grooves have a shape and a dimension which are able to bite somewhat into insulators of the insulated wires of the cable.

8. The insulation-piercing connector as set forth in claim 6, wherein the sectional shape of said opposed walls is selected from shapes substantially in the form of a triangle, trapezoid and rectangle.

9. The insulation-piercing connector as set forth in claim 6, wherein said piercing block is formed with a partial opening at the forward end of each of said wire receiving apertures.

10. The insulation-piercing connector as set forth in claim 6, wherein when said insulated wires of the cable have been inserted into said wire receiving apertures of said piercing block and forward ends of the insulated wires projecting from the forward ends of the wire receiving apertures have been bent upwards, the opposed walls of the U-shaped grooves firmly grip the forward ends of the insulated wires, respectively, so that even after the projecting forward ends of the insulated wires have been cut, cut ends of the insulated wires are able to be seen from above the piercing block.

* * * * *